US005080114A

United States Patent [19]

Rudolph et al.

[11] Patent Number: 5,080,114

[45] Date of Patent: Jan. 14, 1992

[54] SMOKABLE ARTICLE

[75] Inventors: Gert Rudolph; Bernd-Henrik Müller; Guillermo Gerding, all of Hamburg; Bernhard Hauser, Schenefeld; Rolf Kütting, Jesteburg; Knut Möller; Wolfgang Wiethaup, both of Hamburg, all of Fed. Rep. of Germany

[73] Assignee: B.A.T. Cigarettenfabriken GmbH, Hamburg, Fed. Rep. of Germany

[21] Appl. No.: 490,889

[22] Filed: Mar. 9, 1990

[30] Foreign Application Priority Data

Mar. 13, 1989 [DE] Fed. Rep. of Germany ..... 3908160

[51] Int. Cl.[5] ..... A24F 1/22

[52] U.S. Cl. ..... 131/194; 131/359; 131/369

[58] Field of Search ..... 131/359, 369, 194, 195, 131/196

[56] References Cited

U.S. PATENT DOCUMENTS 4,756,318 7/1988 Clearman ..... 131/359

FOREIGN PATENT DOCUMENTS 0271036 6/1988 European Pat. Off. .
1432618 10/1969 Fed. Rep. of Germany .
3904948 3/1989 Fed. Rep. of Germany .

*Primary Examiner*—V. Millin
*Assistant Examiner*—J. Doyle
*Attorney, Agent, or Firm*—Armstrong, Nikaido, Marmelstein, Kubovcik & Murray

[57] ABSTRACT

The invention described here relates to a smokable article which is intended to enable the smoker to avoid the condensates usually present in the smoke while retaining or even enhancing the taste experience familiar from conventional cigarettes or smokable articles; this is achieved by the advantageous geometrical and thermodynamic configuration of the heat source.

25 Claims, 3 Drawing Sheets

SMOKABLE ARTICLE

BACKGROUND OF THE INVENTION

1. Field of the Invention

This invention relates to a smokable article comprising an aerosol generating zone consisting of a combustion element, formed as a hollow cylinder with passages, an aroma capsule and tobacco material, a mouthpiece and a sheath for the aerosol generating zone and the mouthpiece.

2. Description of the Prior Art

For some time discussions have been going on concerning the condensates inhaled with the smoke of burning cigarettes. The cigarette industry is therefore attempting to reduce the portion of these condensates.

U.S. Pat. No. 4,756,318 discloses a smokable article with tobacco material and a combustion element which, via a conduit, is in thermal contact with an aroma capsule. When the combustion element is ignited, the smoker can draw air in the axial direction through the smokable article, in the usual manner, via a mouthpiece, the air being heated at the combustion element and flowing through the porous aroma capsule and the tobacco material without igniting the latter. In this manner, aromatic substances are dissolved, both our of the aroma capsule and out of the tobacco material, and supplied to the smoker, as aerosol, resulting in a corresponding taste or flavouring impression.

Such a smokable article, also described in EP publication 271,036, is intended to permit the smoker to retain the taste and handling properties of conventional cigarettes whilst largely avoiding their disadvantages.

The flavour intensity obtained is, however, relatively small because the supplying of the aroma capsule with hot air, from the combustion element, is inadequate and, consequently, the aromatic substances, dissolved out of the aroma capsule, or tobacco jacket, do not guarantee optimum "smoking enjoyment".

Furthermore, the smokable articles, according to the aforementioned publications, have the disadvantage that their combustion elements can collapse after a short combustion duration. This leads to the combustion element, after a momentary very intensive emission of heat, supplying only very little heat, or even disintegrating. This results in a further impairment of the thermal balance, or even termination of the heat generation, in conjunction with greatly reduced smoking enjoyment.

SUMMARY OF THE INVENTION

The invention is, therefore, based on the problem of providing a smokable article of the specified category in which the aforementioned disadvantages do not occur. In particular, a smokable article is provided which enables the smoker to, largely, avoid the undesired condensates, whilst retaining optimum smoking enjoyment.

The invention proposes, in a smokable article comprising an aerosol generating zone, consisting of a combustion element, formed as hollow cylinder with passages, an aroma capsule and tobacco material, a mouthpiece and a sheath for the aerosol generating zone and the mouthpiece, the improvement that, in the internal diameter of the combustion element, a blocking and support element of heat-resistant material is arranged and the combustion element has a length of 5 to 40 mm, preferably 5 to 15 mm, an internal diameter of 2 to 8 mm, preferably 2.5 to 5.5 mm, and an external diameter of 3 to 10 mm, preferably 4 to 7 mm. Expedient forms of embodiment are defined by the features of the subsidiary claims.

The advantages achieved with the invention are based on the formation of the combustion element, as hollow cylinder, with a concentric blocking and support element disposed in the internal diameter thereof, and consisting of heat-resistant material, in particular metal, for example aluminium, or ceramic.

To avoid a collapse of the combustion element the blocking and support element is formed so that it can take up the static instabilities occurring during the combustion operation and, at the same time, due to its thermal capacity, can extend the use duration of the smokable article, i.e. the blocking, or barrier, element extends over a certain distance in the longitudinal axial direction in the combustion element. Depending on the desired degree of ventilation, and the desired temperature, it may be advantageous to provide the blocking element with at least one opening serving as additional air bypass.

The combustion element is provided with passages/bores which pass through the combustion element, axially parallel from one end side to the other end side, the gas flow containing, apart from the hot gas formed by the combustion, a fraction of only heated air, substantially uninfluenced by the combustion. Supplementarily, or alternatively, the inner and/or outer surface of the combustion element may be corrugated, grooved, serrated or stepped so that substantially longitudinally axially orientated air passages are formed. With this configuration of the combustion element and predetermined dimensions still to be explained, surprisingly the heat balance can be improved in such a manner that the aromatic substances present, which of course are activated by heat, impart a particularly intensive taste impression.

In addition, the improved heat balance is also very advantageous in so far as smouldering gases can largely be avoided.

Extensive tests have shown that, with a combustion element having an internal diameter of 2 to 8 mm, preferably 2.5 to 5.5 mm, and an external diameter of 3 to 10 mm, preferably 4 to 7 mm, the efficiency of the combustion process is almost optimum. This is explained by the fact that a specific ratio is necessary between the ventilation cross-section pointing outwardly (in the ignition direction) and the porous combustion material with a void proportion of about 20 to 50% in which a certain combustion material volume is ignited, in order to ensure the optimum utilization of the combustion material. From a certain length of the combustion element onwards, which lies between 5 and 40 mm, preferably between 5 and 15 mm, this length must also be included in the calculation of the ventilation cross-section to obtain optimum utilization of the combustion material. For example, it may be advantageous for a smokable article, having a particularly long combustion element (length for example 30 mm) and, thus, long lasting smoking enjoyment, to provide an internal and external diameter which approaches the specified limits of 8 and 10 mm, respectively. In addition, in the dimensioning, account must be taken of the wall thickness of the combustion element because this is a decisive factor governing the amount of combustion material offered. To ensure that the amount of combustion material available comes into a suitable range, the wall thickness should lie between 1 and 2 mm, particularly advantageously between 1.2 and 1.5 mm.

The heat balance, governed primarily by the combustion element, can also be advantageously configured by forming axially parallel bores in the combustion element which are "blind" and serve for additional oxygen supply to the combustion material of the combustion element.

A combustion element, kept within these dimensioning limits, obtains the desired properties if at least 4 axial-parallel through bores are provided. These passages should preferably be arranged equidistant, both with respect to each other and with respect to the internal and external walls of the combustion element Depending on the form of the adjoining aroma capsule, a conically or stepwise tapered form of the combustion element may be advantageous for optimum aerodynamic guiding of the gas streams introduced by the combustion element into the aroma capsule and controlling the heat balance of the entire system during smoking.

The aroma capsule is connected to the combustion element, in thermoconductive and aerodynamic manner, in the flow direction. It may be advantageous, on the one hand, to connect the aroma capsule, in geometrical extension, to the combustion element, both having the same internal and/or external diameters in the joint plane and, on the other hand, to arrange the aroma capsule, in the axial direction, geometrically offset with respect to the combustion element in order to additionally positively influence the balance and the flow behaviour of the smokable article.

A particularly pleasant aroma effect can be achieved if the aroma capsule is, likewise, formed as hollow cylinder from thermally conductive material, such as, for example, metal or ceramic, because, in this case, the tobacco material can be accommodated in the hollow cylinder of the aroma capsule and a great amount of aromatic substances is given off through the intimate (thermal) contact.

The aroma capsule, which can expediently consist of substantially heat-resistant material, for example, aluminium or ceramic material, is filled with a substrate (carrier material) consisting advantageously, of inert materials, for example, suitable ceramic fibres or porous structured bodies, or of sintered porous metal oxide, in particular, aluminium oxide beads, which are impregnated with aroma or flavour carriers. These aroma or flavour carriers are activated by heat, i.e. under the action of heat they give off their aromatic or flavouring substances to the surroundings.

As aromatic or flavouring substances, it is possible to use, for example, tobacco extracts and/or nicotine (compounds) and/or higher boiling esters and/or higher boiling alcohols, such as coffee aromas, or the like.

To still further increase the heat yield for the aroma capsule, it may be necessary for the thermally conductive material of the aroma capsule to contact the combustion element on the mouth side or, in the mouth-side extension direction, contact 20 to 100% of the inner, and/or 20 to 100% of the outer, surface of the combustion element.

In addition, to further improve the aroma emission and, thus, enhance the taste experience, it is advantageous for at least part of the outer surface and/or the inner surface of the aroma capsule to have thermal contact with the tobacco material.

The tobacco material may consist of cut tobacco, expanded tobacco or reprocessed tobacco, or of a mixture of the aforementioned tobaccos. The tobacco material may, additionally, be provided with aroma-forming or flavouring substances.

The tobacco material, and/or the aroma capsule, may contain biotechnically produced plant or vegetable material, for example tobacco and/or coffee, preferably, with increased contents of active and flavouring substances known per se. The preparation from cell cultures may, for example, be carried out by the spray drying of cell material known per se.

As a mouthpiece for a smokable article, a filter of cellulose acetate or polypropylene, or a dual filter, may be used. A dual filter contains, for example, on the ignition side, tobacco foil or paper and, on the mouth side, cellulose acetate or polypropylene. Possibly, a ventilation of the mouthpiece may also be provided.

As sheath, at least for part of the length of the combustion element, a concentrically formed insulating layer is provided for advantageously influencing the thermal balance. For improved effect, such insulating layer may project slightly beyond the combustion element on the ignition side, preferably a maximum of 2 mm.

The insulating layer may consist of ceramic or ceramic fibres, in particular, glass fibres, or be made as fleece, or as sleeve-like tube, from such materials.

In the event that the aroma capsule is filled with particularly fine substrate, it is advantageous to provide a sieve-like, air-permeable, separation between the aroma capsule and the combustion element.

In addition, for reasons of further optimizing the heat balance, it is advantageous if, between the aerosol generating zone and the mouthpiece, a hollow chamber, or a gas-permeable separating layer, is provided for avoiding direct thermal contact. This function can also be performed by the tobacco material, if it extends in the direction of the mouthside, beyond the end of the aroma capsule, and partially fills out the total cross-section of the smokable article.

Depending on the constructional form and technical production implementation of the product, subsegments may be equipped with outer sheets, for example, the ignition-side combustion element, with insulating layer, or the adjoining aroma capsule/tobacco material segment, as well as combinations of at least two subsegments. For simplicity, hereinafter reference will be made generally only to one (common) outer sheath.

BRIEF DESCRIPTION OF THE DRAWINGS

The invention will be explained in detail, hereinafter, with the aid of examples of embodiment with reference to the schematic drawings enumerated below.

In the drawings

In the Figures spaces have been left between the individual components to enable details to be clearly shown.

These spaces are partially or totally absent in the real embodiment.

DESCRIPTION OF THE PREFERRED EMBODIMENTS

Figure 1:
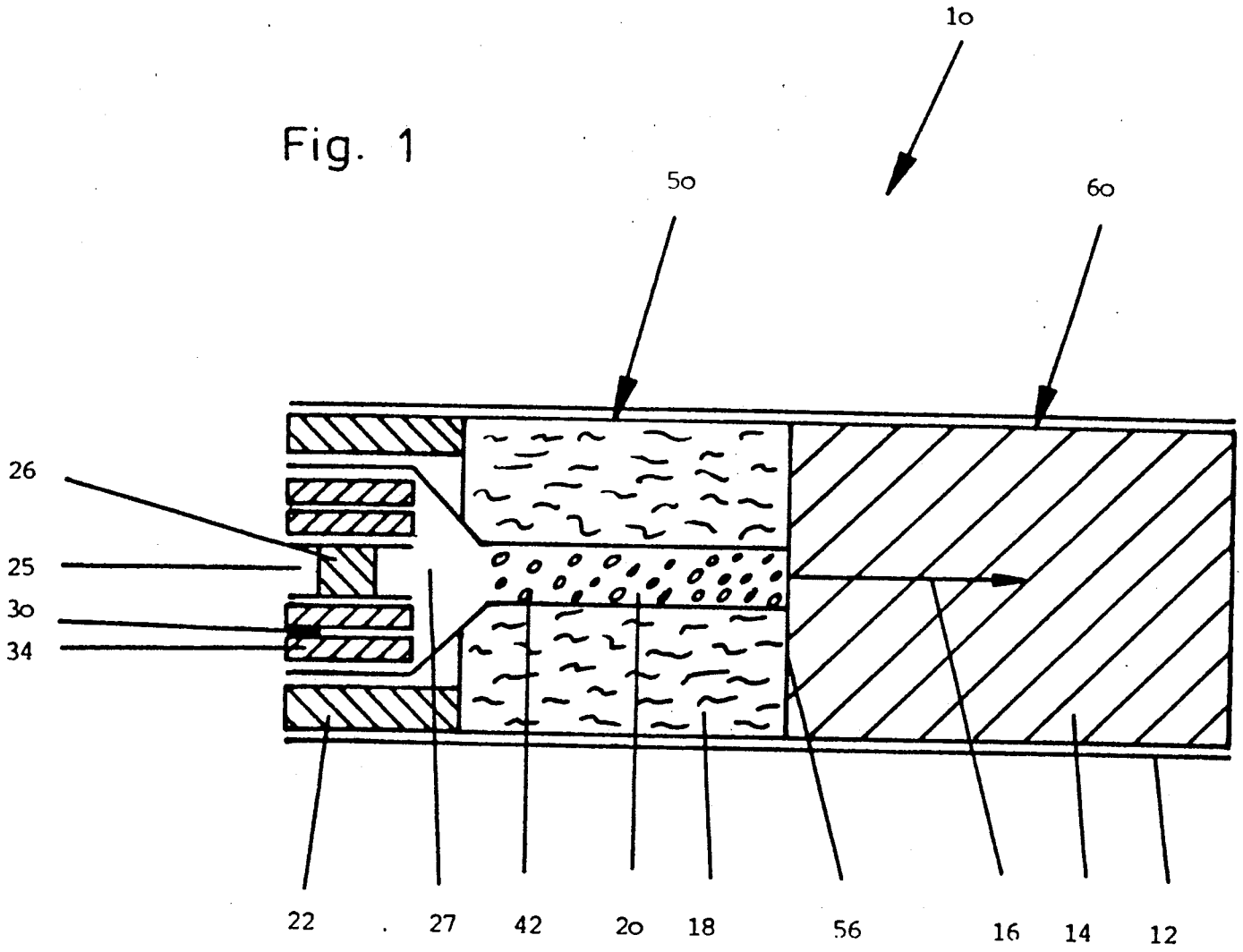
FIG. 1 shows an axial longitudinal section through a first embodiment of the smokable article.

The smokable article shown in FIG. 1, and indicated generally by the reference numeral 10, comprises an outer sheath 12 of a relatively air-impermeable material (e.g. paper or plastic) which surrounds a mouthpiece 60 and an aerosol generating zone 50. The mouthpiece 60 is formed as monofilter 14 of cellulose acetate, or polypropylene, or as dual filter, for example, from tobacco foil and/or paper, for the ignition-side segment, combined with the aforementioned materials, for the mouthside segment. The two regions, 50 and 60, are separated from each other by a gas-permeable separating layer 56.

In the embodiment illustrated, the mouthpiece 60 consists of a monofilter 14 and directly adjoins the separating layer 56 which consists of a gas-permeable relatively heat-resistant material, and, thus, adjoins the tobacco material 18 and an aroma capsule 20 in the zone 50. A hollow cylindrical combustion element 34 is connected, thermally and aerodynamically, to the aroma capsule 20. The hollow cylindrical combustion element 34 is provided with at least four air passages which are uniformly distributed over the cylinder periphery. The inner circular bore 25 through the hollow cylindrical combustion element 34 is sealed with a blocking and support element 26. The barrier or blocking element 26 imparts to the combustion element 34 adequate static stability and, due to its thermal capacity, also forms a heat reservoir. The blocking, or barrier, element 26 may be provided with one or more openings in order to create an additional air bypass.

The bubbles 42, indicated in the aroma capsule 20, denote the porosity of the substrate (carrier material) which is impregnated with aroma and flavouring substances.

In FIG. 1, the reference numeral 16 denotes the main path which the heated air, or aerosol, takes through the smokable article 10.

An insulation 22, coaxially surrounding the combustion element 34, prevents, on the one hand, thermal energy of the combustion element 34 from being able to be irradiated outwardly, which would render it lost for the smoking process, and, on the other hand, the glow from spreading from the combustion element 34 over the sheath 12, in undesirable manner, to the tobacco material 18. The direct contact between the combustion element 34 and the tobacco material 18 is prevented by the gap 27 formed therebetween.

If the combustion element 34, of the smokable article 10, is ignited and the smoker draws at the mouthpiece 60, or monofilter 14, air is sucked through the porous combustion element 34, the combustion element 34 thereby glows and is heated up. Simultaneously, the air stream is sucked through the passages 30 of the combustion element 34 and therefore heated. The various substreams, coming from the combustion element 34, unite in the gap to form a hot total air stream. This total air stream is then transported through the aroma capsule 20, along the flow path 16, indicated via the monofilter 14, to the smoker. The heat transmitted, via the wall material of the aroma capsule 20 and the air, to the carrier material causes volatilization and entraining of the flavouring and active substances in the air stream.

Alternatively, to the embodiment shown in FIG. 1, the aroma capsule 20, adjoining the combustion element, maybe axially offset.

Figure 2:
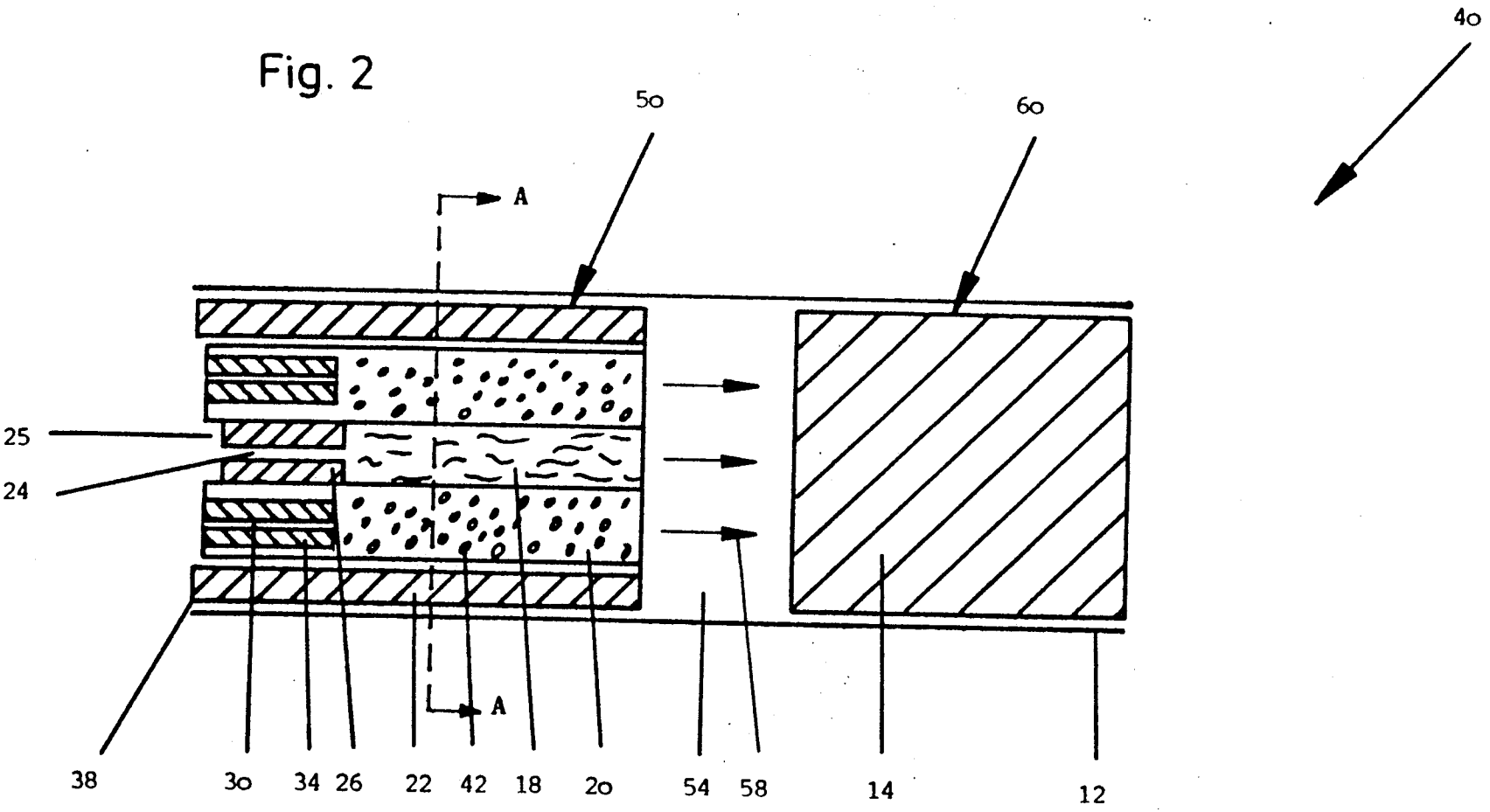
FIG. 2 shows an axial longitudinal section through a second embodiment of the smokable article.

FIG. 2 shows a preferred embodiment of the smokable article denoted, generally, by the reference numeral 40. In contrast to the embodiment illustrated in FIG. 1, in this case the aerosol generating zone 50 is separated by a cavity 54 from the mouthpiece 60. In addition, the aroma capsule 20 is formed, as is the combustion element 34, as hollow cylinder. The tobacco material 18, which, in the smoking process, is likewise heated and traversed by the air stream and thus enriches the latter with aromatic substances, is arranged in the hollow cylinder of the aroma capsule 20. The insulating layer 22 extends here over the entire length, both of the combustion element 34 and of the hollow cylindrical aroma capsule 20.

The reference numeral 38 denotes a slightly projecting region of the correspondingly dimensioned insulating layer 22.

The smoking process here proceeds similarly to the embodiment, which is apparent from FIG. 1. The path of the hot air enriched with aerosols is indicated here by arrows 58.

The examples of embodiment illustrated in FIGS. 1 and 2 show smokable articles 10, 40 which are rod-shaped, preferably of circular cross-section and in particular have the form of a cigarette. The length of such a smokable article 10, 40 is about 50 to 100 mm and its diameter at least 7 mm. The combustion element 34, formed as hollow body, in particular a hollow cylinder, has a length of 5 to 40 mm, preferably a length of 5 to 15 mm. The internal diameter of the combustion element 34 lies between 2 and 8 mm, preferably between 2.5 and 5.5 mm. The combustion element 34 will usually have an external diameter of 3 to 10 mm, preferably 4 to 7 mm. The wall thickness of the combustion element 34, which is a factor governing the amount of combustible material lies between 1 and 2 mm, preferably between 1.2 and 1.5 mm. The combustible material of the combustion element consists an carbon, or prepyrolized plant material, and is made by extrusion from mixtures of the aforementioned materials with binding agents, combustion-influencing agents and possibly flavour-influencing additives, or aromatic substances. The empty volume, with respect to the total volume, is 20 to 50%, expressing the porosity of the combustion element 34.

The aroma capsules 20, referred to in the above examples of embodiment 10, 40, are hollow bodies of thermally conductive wall material which are in thermally conductive and flow connection with the combustion element 34 and follow the latter geometrically, directly or slightly offset. The wall material consists preferably of metal, in particular aluminium.

The bubbles 42 indicate the porous aroma granulate or substrate which is provided with aerosol and/or flavoring substances. As apparent from FIGS. 1 and 2 the wall material of the aroma capsule surrounds at least parts of the combustion element 34 from the mouth side. The surrounded outer, or inner, surface of the combustion element makes up a portion of 20 to 100%. The embodiment of the aroma capsule 20, illustrated by FIG. 1, has a length of 10 to 50 mm and a diameter of 2 to 8 mm. The embodiment of the aroma capsules 20, illustrated in FIG. 2, has an internal and external diameter comparable to the combustion element 34, whilst the length can, likewise be, 10 to 50 mm.

Using the aforementioned dimensions for the combustion element 34, and the aroma capsule 20 it is possible to dissolve the necessary aromatic substances out of the granulate or substrate 42. The porous granulate 42 consists, for example, of sintered porousmmetal oxide, in particular, aluminium oxide, beads which are impregnated with tobacco extract, nicotine (compounds), aromatic substances, higher boiling esters and alcohols, such as, for example, glycerol, and, possibly, with further aerosol, or flavouring substances, activated by heat.

The tobacco material 18, illustrated in FIGS. 1 and 2, consists of cut tobacco, expanded tobacco, reprocessed tobacco or mixtures of these components. The tobacco material 18 can be replaced, at least partially, by biotechnically produced plant material, for example coffee or tea, or also by inert fillers known, per se.

Figure 3:
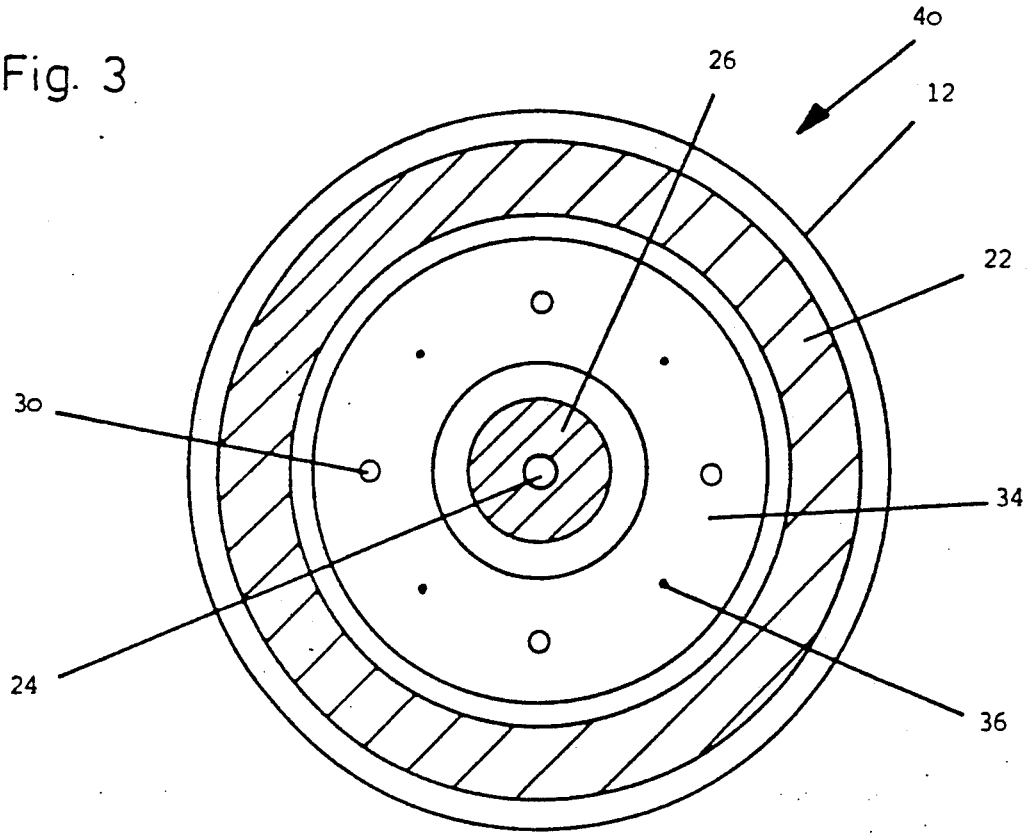
FIG. 3 shows an ignition-side plan view of the embodiment of FIG. 2

The ignition-side plan view of the example of embodiment of FIG. 2, shown in FIG. 3, also illustrates the outer sheath 12, the insulating layer 22, the combustion element 34 and an air passage 24 which, by way of exception, is also drawn in this case. Round the blocking and support element 26 both the four through passages 30 in the combustion element 34 and the blind bores 36, which serve, inter alia, as additional oxygen supply passages for the combustion element 34, are illustrated.

Figure 4:
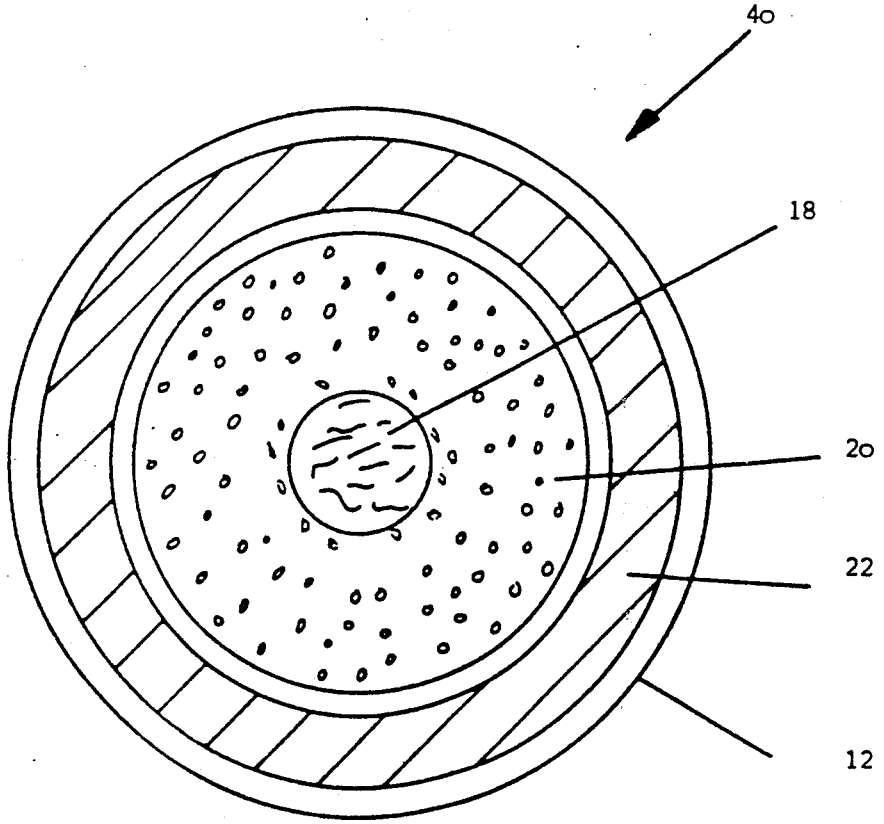
FIG. 4 is a cross-section through the embodiment of FIG. 2 along the sectional plane A—A.

The cross-section shown in FIG. 4 through the smokable article along the section line A—A, indicated in FIG. 2, shows, inter alia, the inwardly arranged tobacco material 18. The hollow cylindrically shaped aroma capsule 20 is disposed round such material. The capsule is, in turn, surrounded by the insulating layer 22. The sheath 12 again forms the outermost wrapper.

We claim:

1. A smokable article comprising
a sheath;
a mouthpiece at one end of said sheath and filling said one end of said sheath;
an aerosol generating zone filling the other end of said sheath, said aerosol generating zone consisting of
a tubular combustion element at the outer end of said other end of said sheath and having air passages extending axially therethrough with a blocking and supporting core of heat-resistant material therein,
an aroma capsule and
tobacco material in said sheath intermediate said mouthpiece and said combustion element, wherein said combustion element has
a length of 5 to 40 mm,
an internal diameter of 2 to 8 mm, and
an external diameter of 3 to 10 mm.

2. A smokable article according to claim 1, wherein said blocking and support core has at least axially extending air passage extending therethrough.

3. A smokable article according to claim 1, wherein said aroma capsule and said combustion element are in axial alignment and both have the same internal and external diameters.

4. A smokable article according to claim 1, wherein said combustion element is surrounded by a concentric insulating layer.

5. A smokable article according to claim 1, wherein at least four axial-parallel through air passages are formed in said combustion element.

6. A smokable article according to claim 1, wherein said passages in said combustion element are arranged equidistant with respect to each other.

7. A smokable article according to claim 1, wherein said combustion element is tapered on the mouthpiece side of said combustion element.

8. A smokable article accord to claim 1, wherein said combustion element has an empty volume of 20 to 50%.

9. A smokable article according to claim 1, wherein said aroma capsule is a hollow cylinder of thermally conductive material.

10. A smokable article according to claim 1, wherein said aroma capsule comprises a capsule wall having at least one additional opening on the mouthpiece side of said capsule.

11. A smokable article according to claim 1, wherein said aroma capsule has a wall material on the mouth side which contacts at least parts of said combustion element and from the mouth-side extension direction, contacts 20 to 100% of the inner and 20 to 100% of the outer surface of said combustion element.

12. A smokable article according to claim 1, wherein said aroma capsule has a wall and between said wall and one of the outer and inner surfaces of said combustion element, substantially longitudinally axial air passages are formed by grooved, serrated, corrugated or steplike configuration extending along said one of said surfaces.

13. A smokable article according to claim 1, wherein said combustion element is a combustion material of carbon or prepyrolized plant material or a mixture thereof.

14. A smokable article according to claim 1, wherein said combustion element is a mixture of carbon and prepyrolized plant material, binding agents, combustion-influencing agents and contains aroma and flavouring substances.

15. A smokable article according to claim 4, wherein said insulating layer has a region projecting not more than 2 mm on the ignition side.

16. A smokable article according to claim 4, wherein said insulating layer is formed from glass fibres, or as fleece or sleeve-like tube of said glass fibres.

17. A smokable article according to claim 1, wherein said aroma capsule is of sintered porous aluminum oxide beads enriched with aerosol-forming substances activatable by heat.

18. A smokable article according to claim 17, wherein said aerosol-forming substances contain tobacco extracts and higher boiling esters and alcohols.

19. A smokable article according to claim 1, wherein said at least one of said aroma capsule and said tobacco material contain bio-technically produced tobacco and/or coffee, with increased contents of active or flavouring substances.

20. A smokable article according to claim 1, wherein said tobacco material consists of cut tobacco, expanded tobacco or reprocessed tobacco or mixtures thereof with aroma-forming substances.

21. A smokable article according to claim 1, wherein said mouthpiece is a monofilter of cellulose acetate or polypropylene.

22. A smokable article according to claim 1, wherein said mouthpiece is formed as dual filter with a segment of tobacco foil or paper on the ignition side and cellulose acetate or polypropylene on the mouth side.

23. A smokable article according to claim 1, wherein a sieve-like air-permeable separation is disposed between said combustion element and said aroma capsule.

24. A smokable article according to claim 1, wherein a hollow chamber or a gas-permeable separation layer is provided between said aerosol generating zone and said mouthpiece.

25. A smokable article according to claim 1, wherein said combustion element has
a length of 5 to 15 mm,
an internal diameter of 2.5 to 5.5 mm and
an external diameter of 4 to 7 mm.

* * * * *